US005520533A

United States Patent [19]

Vrolijk

[11] Patent Number: 5,520,533

[45] Date of Patent: May 28, 1996

[54] APPARATUS FOR MODULATING THE FLOW OF AIR AND FUEL TO A GAS BURNER

[75] Inventor: Enno Vrolijk, Dalen, Netherlands

[73] Assignee: Honeywell Inc., Minneapolis, Mass.

[21] Appl. No.: 282,335

[22] Filed: Jul. 29, 1994

[30] Foreign Application Priority Data

Sep. 16, 1993 [EP] European Pat. Off. ..... 93114902

[51] Int. Cl.[6] ..... F23N 1/02

[52] U.S. Cl. ..... 431/90; 431/12; 137/100

[58] Field of Search ..... 431/12, 89, 90; 137/98, 100, 486, 489, 110

[56] References Cited

FOREIGN PATENT DOCUMENTS

| | | | |
|---|---|---|---|
| 0062854 | 10/1982 | European Pat. Off. | 431/12 |
| 0110071A1 | 6/1984 | European Pat. Off. . | |
| 0275568A1 | 7/1988 | European Pat. Off. . | |
| 0326880B1 | 8/1989 | European Pat. Off. . | |
| 0390964A3 | 10/1990 | European Pat. Off. . | |
| 2708858 | 9/1978 | Germany | 431/90 |
| 8300157 | 9/1983 | Germany . | |
| 01654419 | 8/1985 | Japan | 431/90 |
| 1507020 | 4/1978 | United Kingdom . | |

OTHER PUBLICATIONS

Honeywell Product Brochure V5435A/V5435B Gas–Air Ratio Module (No Date).

*Primary Examiner*—Carl D. Price
*Attorney, Agent, or Firm*—Charles L. Rubow

[57] ABSTRACT

A burner control system for controlling gas flow to a burner in response to a pressure differential indicative of air flow to the burner, the pressure differential being impressed across a diaphragm which actuates a bleed valve controlling the pressure on one side of the diaphragm actuator of a fuel valve. The bleed chamber is connected to the outlet of the gas valve and the low pressure side of a pressure differential through separate flow restrictors.

12 Claims, 1 Drawing Sheet

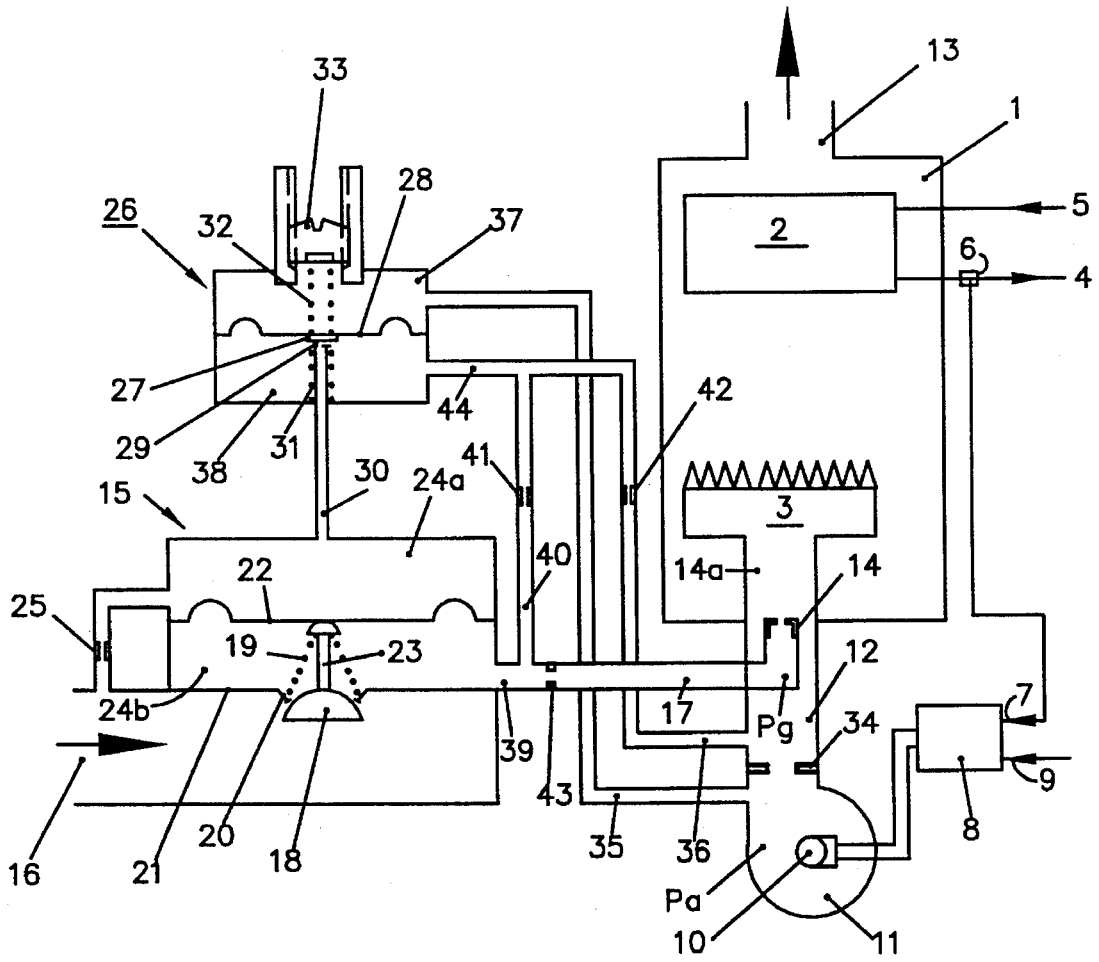
33
13
1
28
26
32
37
5
2
6
4
27
44
42
29
31
38
30
24a
41
3
15
40
14a
14
22
25
19
23
12
24b
17
Pg
34
7
39
43
9
8
16
21
20
18
35
36
Pa
10
11

APPARATUS FOR MODULATING THE FLOW OF AIR AND FUEL TO A GAS BURNER

BACKGROUND OF THE INVENTION

The invention set forth herein relates generally to modulating fuel/air controls for gas burners, and more particularly to a system of the type in which heat output of a burner is varied by varying air flow to the burner and in which a substantially constant fuel/air ratio or other fuel/air characteristic is maintained by varying fuel gas flow in response to the air flow.

For a variety reasons in apparatus for heating space and/or hot water for domestic use, it is frequently desirable to employ mechanical means such as a fan or blower for inducing or forcing air flow through a combustion chamber. In such systems, it is also frequently desirable to modulate the heat output of the burner. A common system arrangement for accomplishing these objectives utilizes a variable speed fan or blower under thermostatic control. A signal indicative of the air flow through the combustion chamber is used to modulate the output of a fuel gas regulator valve which supplies gas to the burner. The air flow signal may be a pressure differential generated across an orifice or by means of a venturi section in the air flow passage. An objective of the system design is to for example maintain a substantially constant fuel to air ratio at the burner so as to provide a fuel mixture in which combustion is easily started and high efficiency combustion is maintained.

Apparatus of this general type is disclosed in European Patent Application 0 390 964. More specifically, the differential pressure indicative of air flow is applied across a large area control diaphragm of an amplifying pneumatic control module. Displacement of the large area diaphragm is communicated to a smaller area regulating diaphragm by means of a spring. The regulating diaphragm carries a closure member of a bleed valve which affects a control pressure in a main gas valve containing a secondary servo valve whose closure member is spring biased to limit the maximum output gas pressure. Adjustable biasing of the large and small diaphragms in the control module is accomplished by means of a spring and an associated adjustable retainer screw.

Somewhat similar control apparatus is disclosed in European Patent Application 0 326 880 in which a first diaphragm chamber of a control module is connected to a venturi nozzle in the combustion air passage of a burner system, and an opposing second diaphragm chamber is connected to a pressure port downstream from the venturi nozzle. The control module directly actuates the main gas valve by means of a valve rod connecting the control module diaphragm to the gas valve closure member.

Another burner control arrangement is shown in German utility model publication 83 00 157 in which gas and air flow to a burner are controlled by separate controllers or valves. The air flow controller includes a thermostatically controlled pressure regulator. The regulated output pressure of the air flow controller is supplied to the gas valve through a pneumatic amplifier therein as its control signal.

Although the previously described systems provide modulating operation and are capable of achieving a desired fuel/air ratio for a particular type of gas under relatively constant pressures and other parameters, additional adaptability for use with other types of gasses and under more variable conditions would be desirable. The applicant has devised a burner control system which provides improvements in meeting these objectives.

SUMMARY OF THE INVENTION

The invention is a burner control system in which a differential pressure signal proportional to the flow rate of combustion air is directly pneumatically compared with the gas pressure at the outlet of a gas control valve. This comparison is used to derive a pneumatic control signal for controlling the diaphragm operator of a main gas valve.

In particular, the air flow rate is indicated by a pressure differential between high and low pressure ports respectively connected to control and bleed chambers on opposite sides of a diaphragm in a control module, of which the bleed chamber is connected through a bleed valve actuated by the control module diaphragm to a control chamber on one side of a diaphragm in the main gas valve, the control chamber also being connected through a first flow restrictor to a gas inlet of the gas valve. The other side of the diaphragm in the gas valve is exposed to the pressure of gas supplied through a gas outlet to the fuel nozzle. A second flow restrictor connects the bleed chamber of the control module to the gas outlet of the gas valve and a third flow restrictor is provided in the passageway connecting the bleed chamber of the control module to the low pressure port.

The second and third flow restrictors are preferably sized so that the ratio of the fuel gas pressure and air pressure equals the sum of the resistances of the first and second restrictors divided by the resistance of the second restrictor. System operation may be enhanced by including a fourth flow restrictor in the passageway between the gas valve outlet and the gas nozzle.

BRIEF DESCRIPTION OF THE DRAWING

The single FIGURE of the drawing is a functional schematic representation of the preferred embodiment of a system in accordance with the applicant's invention.

DESCRIPTION OF THE PREFERRED EMBODIMENT

In the FIGURE, reference numeral 1 identifies a closed combustion chamber of a gas-heating apparatus. Combustion chamber 1 contains a heat exchanger 2 and a burner 3, which is supplied with a fuel and air mixture as set forth in detail hereinafter. Heat exchanger 2 is illustrated as a gas to water heat exchanger which is connected via a supply pipe 4 and a return pipe 5 to a load (not shown). A temperature sensor 6 measures the supply temperature of the hot water supplied to the load and provides a corresponding signal to a measured value input 7 of a temperature controller 8. Controller 8 also receives a setpoint signal at a setpoint input 9. The setpoint signal, which may be manually adjusted, corresponds to the desired temperature. Controller 8 controls the energy supply to a motor 10 driving a blower 11 which supplies combustion air to burner 3 via an air passageway 12. The exhaust gases leave combustion chamber 1 via a stack 13. As shown, a gas nozzle 14 is provided in passageway 12 and is supplied with gas from a gas control valve 15. Although a particular arrangement of the air supply, gas supply and a mixing chamber **14*a* is illustrated, these elements may be designed or positioned differently. For example, blower 11 may be provided in stack 13**.

Gas control valve 15, which functions as the main gas valve, is provided between a gas inlet 16 and gas outlet 17. Main gas valve 15 includes a closure member 18 spring biased toward a closed position by means of a spring 19. Closure member 18 cooperates with a valve seat 20 in a wall 21 of the valve housing. Closure member 18 is operated by a diaphragm 22 via a valve rod 23. Diaphragm 22 and portions of the valve housing define first and second control chambers 24*a* and 24*b* on opposite sides of the diaphragm. Control chamber 24*a* is connected to gas inlet 16 via a first flow restrictor 25, and to a bleed valve provided in a control module 26.

Control module 26 includes a closure member 27 carded by a diaphragm 28. Closure member 27 cooperates with a valve seat 29 to form a bleed valve 27, 29 which is connected to control chamber 24*a* via a passageway 30. A spring 31 on one side of diaphragm 28 is arranged to bias closure member 27 toward an open position, and a spring 32 between the opposite side of the diaphragm and an adjustment screw 33 acts in the opposite direction.

The combustion air flow rate generated by blower 11 is measured by means of a differential pressure measuring device provided in air passageway 12, which device includes an orifice 34 in the passageway, a first measuring passageway 35 porting into air passageway 12 at the upstream or high pressure side of orifice 34, and a second measuring passageway 36 porting into air passageway 12 at the downstream or low pressure side of the orifice.

Measuring passageway 35 is connected to a control chamber 37 in control module 26 on one side of diaphragm 28. Control module 26 also contains a bleed chamber 38 on the opposite side of diaphragm 28. Bleed chamber 38 is connected to an outlet port 39 of main gas valve 15 via a passageway 40 containing a second flow restrictor 41, and to low pressure measuring passageway 36 via a third flow restrictor 42. Flow restrictors 41 and 42 preferably are both adjustable. A fourth flow restrictor 43, which may be adjustable, is shown in the gas outlet 17 between passageway 40 and gas nozzle 14.

The speed of blower 11, and therefore the flow rate of combustion air is controlled by means of controller 8 according to the heat demand. As the air flow rate increases, the pressure in measuring passageway 35 increases. The pressure increase is transmitted to control chamber 37, thereby deflecting diaphragm 28 in a downward direction. This tends to close bleed valve 27, 29 and increase the pressure in control chamber 24*a*, which tends to open main valve 18, 20. Accordingly, the increased air flow rate results in an increased gas flow rate.

Flow restrictors 41 and 42, which communicate with bleed chamber 38 through a passageway 44, function to convert the previously described operation into closed loop control. Passageway 40 containing flow restrictor 41 couples bleed chamber 38 of control module 26 with output port 39 of main gas control valve 15. If for any reason the gas pressure at output port 39 increases, then the pressure in passageway 44 also increases. This increases the pressure acting on the lower side control diaphragm 28, which tends to open bleed valve 27, 29 and decrease the pressure in control chamber 24*a*. As a result, spring 19 tends to close gas valve 18, 20 and reduce the gas pressure at output port 39. In this manner the air flow rate and the gas flow rate are pneumatically linked to provide a feed forward control.

Flow restrictor 42 between bleed chamber 38 and low pressure measuring passageway 36 both enables pressure to be built up in passageway 44, and permits bleeding off the pressure within bleed chamber 38 when bleed valve 27, 29 is closed.

The dependency of the gas pressure $P_g$ within gas nozzle 14 from the air pressure $P_a$ generated by blower 11 can be described by the following formula if flow restrictor 43 is ignored:

$$P_g=(R_{41}+R_{42})/R_{42}\times P_a$$

$R_{41}$ and $R_{42}$ are the flow resistances of the flow restrictors 38 and 40, respectively. The pneumatic gain of the control module 26 is assumed to be unity. For the pressure $P_{38}$ within bleed chamber 38 the following formula applies:

$$P_{38}=R_{42}/(R_{41}+R_{42})\times P_g$$

If the pressure within mixing chamber 14*a* is designated $P_m$, the following pressure differences appear:

$$dP_g=P_g-P_m$$

$$dP_a=P_a-P_m$$

$$dP_{38}=P_{38}-P_m$$

It follows that:

$$dP_g=(R_{41}+R_{42})/R_{42}\times dP_a$$

$$dP_{38}=R_{42}/(R_{41}+R_{42})\times dP_g$$

The gain or proportionality factor, by which a change of the gas pressure $dP_g$ is linked to a change of the air pressure $dP_a$, therefore, can be determined in a desired manner by means of flow restrictors 41 and 42. By repositioning adjusting screw 33 for spring 32, the system offset can be adjusted. A fine adjustment of the gas/air ratio can be accomplished by means of flow restrictor 43.

Although a variable speed blower is shown and described in the disclosed embodiment for varying air flow rate in response to heat demand, other implementations are equally satisfactory. The air flow rate could, for example, be controlled by a damper or air valve.

The embodiments of the invention in which an exclusive property or right is claimed are defined as follows:

1. A fuel control system for burner apparatus including a gas nozzle and an air passageway for supplying fuel gas and air to a burner in a combustion chamber, the air flow to the burner being variable in response to heat output required from the burner apparatus, the control system comprising:

a flow sensor operable to produce a differential pressure signal between high and low pressure ports thereof indicative of the rate of air flow to the burner;

a gas valve having an inlet for receiving fuel gas from a gas supply and an outlet, the inlet and outlet being connected through a valve seat, said gas valve further having a closure member moveable toward and away from the valve seat by means of a gas valve diaphragm which separates first and second control chambers of which the first control chamber communicates with the outlet so as to be maintained at the outlet gas pressure;

a first passageway for connecting the outlet of said gas valve to the gas nozzle of the burner apparatus;

a second passageway containing a flow restrictor connecting the inlet of said gas valve to the second control chamber thereof;

a control module including a control module diaphragm separating bleed and control chambers communicating with first and second ports respectively, the bleed chamber further communicating with a valve seat through which flow is variably restricted by a moveable closure member carried on the control module diaphragm;

third and fourth passageways respectively connecting the low and high pressure ports of said flow sensor to the first and second ports of said control module, said third passageway containing a flow restrictor;

a fifth passageway providing fluid communication between the valve seat of said control module and the second control chamber of said gas valve; and a sixth passageway containing a flow restrictor connecting the outlet of said gas valve to the first port of said control module.

2. The fuel control system of claim 1 in which said control module includes an adjustable biasing spring cooperating with the diaphragm in said control module to adjustably bias the closure member therein toward the valve seat therein.

3. The fuel control system of claim 2 wherein the flow restrictor in any of said second, third and sixth passageways are adjustable.

4. The fuel control system of claim 3 wherein said first passageway includes an adjustable flow restrictor.

5. The fuel control system of claim 4 wherein the flow resistances of the restrictors in said third and sixth passageways are chosen to achieve the relationship $$P_g=(R_3+R_6)/R_3\times P_n, \text{ where}$$

$P_g$= gas pressure in said first passageway entering the gas nozzle;

$P_a$=pressure at the high pressure port of said flow sensor;

$R_3$=flow resistance of the flow retricts in said third passageway; and $R_6$=flow resistance of the flow restrictor in said sixth passageway.

6. The fuel control system of claim 5 wherein said control module provides substantially unity pneumatic gain.

7. The fuel control system of claim 6 wherein the flow resistances of the second and third flow restrictors are selected such that $$P_g=(R_2+R_3)/R_3\times P_a, \text{ where}$$

$P_g$=gas pressure supplied to the gas nozzle;

$P_a$=air pressure at the high pressure port;

$R_2$=flow resistance of said second flow restrictor; and $R_3$=flow resistance of said third flow restrictor.

8. The fuel control system of claim 7 wherein any of the second, third and fourth flow restrictors are adjustable.

9. In a fuel control system of the type in which heat output of a burner is varied by varying air flow to the burner and in which a predetermined fuel to air ratio relationship is maintained by varying fuel gas flow to a gas nozzle at the burner in response to air flow thereto, the air flow rate being indicated by a pressure differential between high and low pressure ports respectively connected to control and bleed chambers on opposite sides of a diaphragm in a control module, of which the bleed chamber is connected through a bleed valve actuated by the diaphragm to a control chamber on one side of a diaphragm in a gas valve, the control chamber being connected through a first flow restrictor to a gas inlet of the gas valve, the other side of the diaphragm in the gas valve being exposed to the pressure of gas supplied through a gas outlet of the gas valve to the gas nozzle, the improvement which comprises:

a second flow restrictor connecting the bleed chamber of the control module to the gas outlet of the gas valve; and a third flow restrictor in the passageway connecting the bleed chamber of the control module to the low pressure port.

10. The fuel control system of claim 9 wherein the gas outlet of the gas valve is connected to the gas nozzle through a fourth flow restrictor.

11. The fuel control system of claim 8 further including adjustable spring biasing means cooperating with the diaphragm in the control module for adjustably biasing the bleed valve toward a closed state.

12. The fuel control system of claim 11 wherein the control module provides substantially unity pneumatic gain.

* * * * *

UNITED STATES PATENT AND TRADEMARK OFFICE

CERTIFICATE OF CORRECTION

PATENT NO. : 5,520,533

DATED : May 28, 1996

INVENTOR(S) : Enno Vrolijk

It is certified that error appears in the above-indentified patent and that said Letters Patent is hereby corrected as shown below:

Column 5, line 28, cancel the equation and substitute

-- $P_g=(R_3+R_6)/R_3xP_a$ --

Column 5, line 34, cancel "retricts" and substitute --restrictor--.

Signed and Sealed this

Twenty-fourth Day of September, 1996

*Attest:*

*Attesting Officer*

Bruce Lehman

BRUCE LEHMAN

*Commissioner of Patents and Trademarks*